United States Patent [19]

Kuzunuki et al.

[11] 4,326,606

[45] Apr. 27, 1982

[54] APPARATUS FOR CONTROLLING RESCUE OPERATION OF AN ELEVATOR

[75] Inventors: Soshiro Kuzunuki; Kotaro Hirasawa, both of Hitachi; Kazuhiro Sakata; Kenji Yoneda, both of Katsuta, all of Japan

[73] Assignee: Hitachi, Ltd., Tokyo, Japan

[21] Appl. No.: 85,543

[22] Filed: Oct. 17, 1979

[30] Foreign Application Priority Data

Oct. 19, 1978 [JP] Japan ..... 53/129289

[51] Int. Cl.[3] ..... B66B 5/02

[52] U.S. Cl. ..... 187/29 R

[58] Field of Search ..... 187/29

[56] References Cited

U.S. PATENT DOCUMENTS 4,114,730 9/1978 Means et al. ..... 187/29

4,210,226 7/1980 Ichioka ..... 187/29

*Primary Examiner*—Gene Z. Rubinson

*Assistant Examiner*—W. E. Duncanson, Jr.

*Attorney, Agent, or Firm*—Craig and Antonelli

[57] ABSTRACT

The operation control section of an elevator system is constituted of two computers one of which shares the processing function with the other. One of the computers has a means for detecting an abnormality occurring in the other computer and stores therein a program for bringing the elevator cage to the nearest floor when the cage is stopped in an intermediate position between floors. If one of the computers falls in a fault, the cage is immediately stopped for assuring the safety of passengers. If the cage is stopped in the position between floors, the other computer causes the cage to be moved to the nearest floor for the rescue of the passengers.

11 Claims, 17 Drawing Figures

APPARATUS FOR CONTROLLING RESCUE OPERATION OF AN ELEVATOR

This invention relates to an apparatus for controlling the rescue operation of an elevator.

The elevator is the only means of vertical transportation which is conveniently used by people ranging from infants to the aged. Since the elevator cage is moved in the vertical direction, if an abnormality occurs in its control apparatus, there arises an unhappy probability that the passengers may be injured. The safety of the passengers is therefore the most important requirement imposed on the control apparatus for the elevator. Accordingly, when an abnormality is detected in an elevator system at operation, the cage is stopped immediately at any level so as to secure the safety of the passengers. This unexpected stop may sometimes bring the elevator cage into an intermediate position between floors. In that case, the passengers face the possibility of being confined in the cage for a long time. Therefore, it is necessary to rescue the passengers quickly out of the cage.

In elevator systems using a conventional elevator control apparatus, the passengers are rescued by the maintainers' manual operation or by the automatic rescue operation through the minimum function allowable in the system (cf. Japanese Pat. No. 47971/78).

With the recent development of microcomputers having high performance, high reliability and low cost, the micro-computarization of numerous industrial machines is in progress. In the field of elevators, too, systems using microcomputers mainly as group supervision apparatuses have been reported and the systems are now under development in which the elevator control apparatus for controlling the individual cages (hereafter referred to for simplicity as cage controller) is microcomputerized.

However, since a microcomputer has one or several semiconductor chips in which component density is very high and every function is concentrated in a very small area, the slightest fault occuring within could bring the microcomputer out of order, collapsing all the normal functions. It is therefore necessary for the elevator system using such a microcomputer as described-above to be furnished with another means for securing the safety of passengers.

The abnormality or fault occuring in the group supervision control computer will not always lead to the confinement or the accidental injury of passengers since in such a case the group supervision control can be stopped. Moreover, the abnormality of the computer can be easily detected by the well-known artifices such as a watchdog timer, parity check etc.

On the other hand, if a fault occurs in the cage controller to control each elevator cage, the failure in an immediate stop may incur an injurious accident. Accordingly, in such a fault it is likely that the cage will be stopped and kept between floors, with the passengers confined within. And typically the microcomputer is deprived completely of its functions even if a fault occuring therein is only a local one. Therefore, the prior art computerized elevator system cannot perform a rescue operation as could be effected by the conventional system in which the control apparatus is made up of relay circuits and which uses the most limited functions for the rescue operation.

One object of this invention is to provide a rescue operation control apparatus which can quickly rescue the passengers from the cage of the elevator even when an abnormality occurs in the cage control computer used in the elevator system as a cage control section.

Another object of this invention is to provide a rescue operation control apparatus which can improve the processing speed and functions by controlling the operations of the individual cages by plural function-divided computers and which can rescue the passengers from the cages when any one of the computers is out of order.

According to one feature of this invention, besides the first computer for controlling the operation of a cage, a second computer is provided which has at least a function of controlling the rescue operation associated with the cage and which causes the cage to reach the predetermined floor level for the rescue of the passengers.

According to another feature of this invention, the second computer for rescue operation control shares a part of the cage control function of the first computer with the first computer while the first computer is also provided with a function of controlling the rescue operation, whereby when one of the computers gets out of order and loses the control of the operation of cage, the other computer serves to control the rescue operation.

Other objects, features and advantages of this invention will be apparent in the following description of the preferred embodiments of this invention, referring to the attached drawings, in which:

FIG. 1 shows in block diagram the general constitution of an elevator control apparatus;

FIG. 2 is the circuit of an input interface;

FIG. 3 shows the constitution of a main microcomputer;

FIG. 4 is the circuit of an output interface;

FIG. 5 is the circuit for controlling the change-over of buses;

FIG. 6 is a time chart for explaining the operation of the circuit shown in FIG. 5;

FIG. 7 is the general flow chart for explaining the program of the main microcomputer;

FIG. 8 is the general flow chart for explaining the program of the sub-microcomputer;

FIG. 9 is a detailed flow chart of a rescue operation processing program;

FIG. 10 shows an input/output table for cage call used in the rescue operation control processing;

FIG. 11 is an input/output table for the cage position used in the rescue operation control processing;

FIG. 12 is an input/output table for door and safety mechanism used in the rescue operation control processing;

FIG. 13 is an input/output table for rescue operation used in the rescue operation control processing;

FIG. 14 is the flow chart for explaining the program of the main microcomputer;

FIG. 15 is the flow chart for explaining the program of the sub-microcomputer;

This invention will now be explained by way of embodiment with the aid of FIGS. 1–13. In the first embodiment of this invention, two microcomputers are used and they are referred to for convenience as a main microcomputer (also abbreviated as main MICCOM) and a sub-microcomputer (also abbreviated as sub-MICCOM). However, this distinction between their designations does not relate to a functional relationship of one to the other, but is only for the purpose of clearly identifying them, as in the embodiment described later.

Figure 1:
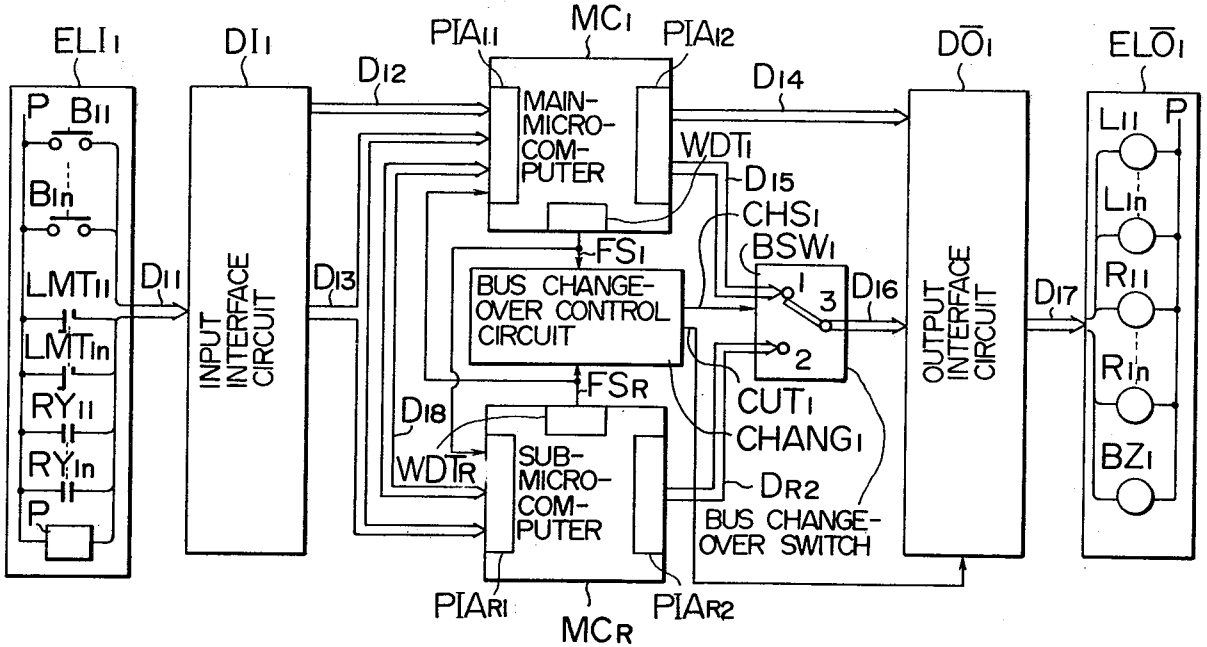
FIGS. 1–13 illustrate one embodiment of this invention.

In FIG. 1, showing in block diagram form the general constitution of an elevator control apparatus as a first embodiment of this invention, $ELI_1$ is an input element block for entering elevator information, comprising cage call buttons near the sliding door of the elevator shaft, floor selecting buttons in the cage, limit switches, relay contacts and cage position detectors; $DI_1$ an input interface circuit for converting the input information to signals having voltages suitable for a microcomputer; $MI_1$ a main MICCOM for controlling the operation of the elevator cage; $MC_R$ a sub-MICCOM for controlling the operation of rescuing the passengers in the cage; $DO_1$ an output interface circuit for amplifying the outputs of the MICCOM's $MC_1$ and $MC_R$; $ELO_1$ an output element block comprising lamps, relays etc.; $CHANG_1$ a bus change-over control circuit for switching over the MICCOM's $MC_1$ and $MC_R$; and $BSW_1$ a bus change-over switch for switching over data buses.

The output element block $ELO_1$ is a drive apparatus for driving the cages and the lamps etc. according to the control signal processed by the main MICCOM $MC_1$ and the sub-MICCOM $MC_R$. The block $ELO_1$ itself is well-known and the explanation thereof will not be given here.

The operation of the circuit shown in FIG. 1 is as follows. The information necessary for the control of the cage, that is, information $D_{11}$ consisting of the outputs from the push buttons $B_{11}$–$B_{1n}$ such as the floor selecting buttons in the cage and the cage call buttons near the sliding door of the elevator shaft, limit switches $LMT_{11}$–$LMT_{1n}$ such as up and down limit switches, relays $RY_1$–$RY_n$ for securing safety or switching heavy current, and a detector P for detecting the signal indicating the position of the cage, is sent to the input interface circuit $DI_1$ to eliminate noise due to the chattering of the relay contacts and to perform a voltage shift. The thus processed outputs are delivered as inputs $D_{12}$ and $D_{13}$ to the main MICCOM $MC_1$ and the sub-MICCOM $MC_R$, respectively. The data $D_{13}$ is used to control the cage and the rescue operation. The data $D_{12}$ and $D_{13}$ is stored in the interior memories of the MICCOM's $MC_1$ and $MC_R$ through their associated peripheral interface adapters $PIA_{11}$ and $PIA_{R1}$. To find out a fault occurring in the sub-MICCOM $MC_R$, the output signal $FS_R$ of the fault detecting circuit $WDT_R$ of the sub-MICCOM $MC_R$ is supplied to the adapter $PIA_{11}$ of the main MICCOM $MC_1$. Also, to check a fault in the main MICCOM $MC_1$, the fault detecting circuit $WDT_1$ of the main MICCOM $MC_1$ is supplied to the adapter $PIA_{R1}$ of the sub-MICCOM $MC_R$. The data bus $D_{18}$ is used for the data communication between the MICCOM's $MC_1$ and $MC_R$.

The arithmetically processed output of the main MICCOM $MC_1$ is delivered as data $D_{14}$ and $D_{15}$ through the adapter $PIA_{12}$. The data $D_{14}$, having nothing to do with the rescue operation control, is directly supplied to the output interface circuit $DO_1$. The data $D_{15}$, associated with the rescue operation control, is supplied to the output interface circuit $DO_1$ as the data $D_{16}$ when the terminals 1 and 3 of the bus switch $BSW_1$ are connected with each other. Thus, the data $D_{16}$ in this case is identical with the data $D_{15}$. It is when the main MICCOM $MC_1$ is normally operating that the terminals 1 and 3 of the bus switch $BSW_1$ are connected with each other. When a fault occurs in the main MICCOM $MC_1$, the terminals 2 and 3 are connected with each other according to the bus change-over signal $CHS_1$ from the bus change-over control circuit $CHANG_1$. In this case, the data $D_{16}$ is identical with the data $D_{R2}$ from the sub-MICCOM $MC_R$. That is, when the main MICCOM $MC_1$ falls in a fault, the bus switch $BSW_1$ is changed over to connect the terminal 3 with the terminal 1 in place of the terminal 2. Accordingly, the sub-MICCOM $MC_R$ controls the rescue operation.

The bus change-over control circuit $CHANG_1$ receives the output signal $FS_1$ of the fault detecting circuit $WDT_1$ in the main MICCOM $MC_1$ and the output signal $FS_R$ of the fault detecting circuit $WDR_R$ in the sub-MICCOM $MC_R$, and delivers the bus change-over signal $CHS_1$. Also, the circuit $CHANG_1$ delivers the signal $CUT_1$ which inhibits the output of the output interface circuit $DO_1$ for a predetermined period of time when the main MICCOM $MC_1$ falls in and recovers from a fault.

The arithmetically processed results from the main and sub-MICCOM $MC_1$ and $MC_R$ are sent through the output interface circuit $DO_1$ to the output element block $ELO_1$, as described above, so that the indicating lamps $L_{11}$–$L_{1n}$, the relays $R_{11}$–$R_{1n}$ and the warning buzzer $BZ_1$ are actuated and the cage is driven.

It is for the purpose of checking a fault in the sub-MICCOM $MC_R$ that the output signal $FS_R$ of the fault detecting circuit $WDT_R$ of the sub-MICCOM $MC_R$ is supplied to the main MICCOM $MC_1$. Now let it be assumed that the main MICCOM $MC_1$ is normally operating and that the sub-MICCOM $MC_R$ is in fault. Then, the main control of the elevator system can be normally performed by means of the main MICCOM $MC_1$, but there is no backup function of controlling the rescue operation since the sub-MICCOM is now abnormal. If the main MICCOM $MC_1$ also falls in a fault in this case, the rescue operation becomes impossible after the cage has been stopped in an emergency. It is therefore necessary to cause the main MICCOM to drive the cage to the nearest floor as soon as possible. In such a state as mentioned above, according to this invention, the already registered or new floor calls are ignored and only one of the registered cage calls is adopted which corresponds to the call of the cage to the nearest floor. Then, the cage is moved to the nearest floor and rests there.

The table I given below summarizes various processings to be performed in the case where the main MICCOM $MC_1$ and/or the sub-MICCOM are in fault.

TABLE I

| $MC_1$ | $MC_R$ | Processings to be performed |
|---|---|---|
| o | o | To contrcl cage by $MC_1$ normally |
| x | o | To connect terminal 3 with terminal 2 in $BSW_1$. To control rescue operation by $MC_R$ so that cage is moved to the nearest floor for rescue of passengers and then rest there. |

TABLE I-continued

| $MC_1$ | $MC_R$ | Processings to be performed |
|---|---|---|
| o | x | To start warning buzzer $BZ_1$ to indicate that $MC_1$ has fallen in a fault. To ignore floor calls and respond to registered cage call. To rest there with door shut after cage has reached nearest floor. |
| x | x | To make an emergency stop and remain stationary |

Note:
o ... normal operation
x ... fault

In the above table I, it is a very serious situation if both $MC_1$ and $MC_R$ are in fault since in this state the passengers are confined in the cage. However, the chance that this case may occur, is very small.

Next, concrete examples of the important components of the general circuit shown in FIG. 1 will be explained.

Figure 2:
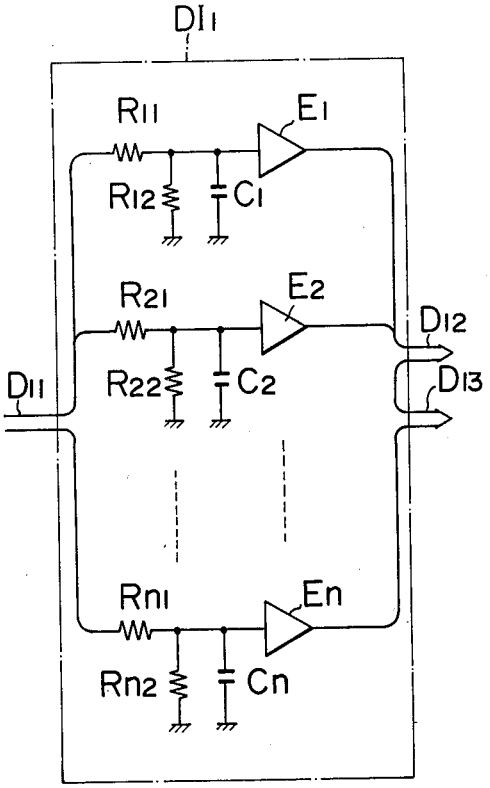

FIG. 2 shows a concrete example of the input interface circuit $DI_1$ shown in FIG. 1, which serves to eliminate chattering due to the making and breaking of contacts and to shift the input voltage level. The information $D_{11}$ from the contact mechanism is subjected to, for example, voltage division by resistors $R_{11}$ and $R_{12}$ and also to chattering absorption by a delay element consisting of the resistors $R_{11}$ and $R_{12}$ and a capacitor $C_1$. The signals without chattering are then wave-shaped to be data $D_{12}$ and $D_{13}$. As shown in FIG. 2, n similar circuits are provided and the outputs of these circuits associated with the rescue operation control constitute the data $D_{13}$ while the outputs of these circuits not associated with the rescue operation control form the data $D_{12}$. It is for the purpose of decreasing the number of the inputs to the adapter $PIA_{R1}$ of the sub-MICCOM $MC_R$ that the outputs are divided into the data $D_{12}$ and $D_{13}$.

Figure 3:
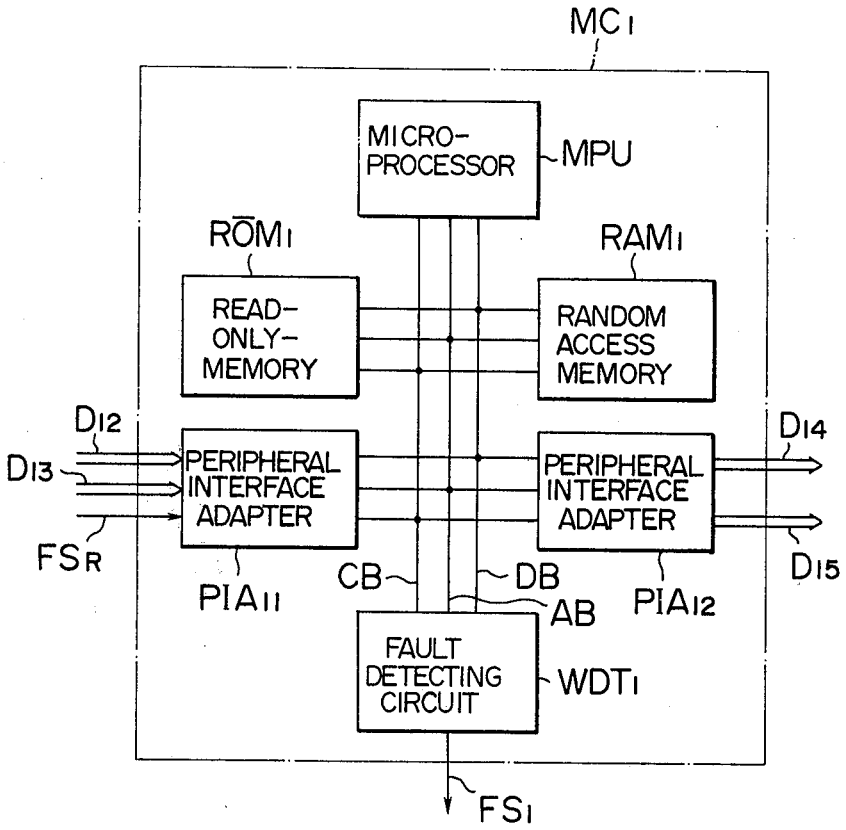

FIG. 3 shows an example of the main MICCOM $MC_1$ shown in FIG. 1. The main MICCOM $MC_1$ comprises a micro-processor $MPU_1$, a read-only-memory $ROM_1$ for storing programs therein, a random access memory $RAM_1$ for storing data therein, an input/output interface circuit $DI_1$, peripheral interface adapters $PIA_{11}$ and $PIA_{12}$ for serving as interfaces with the input/output interface circuits $DI_1$ and $DO_1$, and a fault detecting circuit (watchdog timer) $WDT_1$. These components are interconnected with one another through data bus DB, address bus AB and control bus CB. The arithmetical processing by the main MICCOM $MC_1$, necessary for the door control, the direction control, the call control and the acceleration and deceleration control all associated with the operation of an elevator cage, is performed according to predetermined programs. The structure of the sub-MICCOM $MC_R$ is the same as that of the main MICCOM $MC_1$ and the explanation of the sub-MICCOM is omitted. The term "computer" used in this invention is applied to any device that can have a function of processing data according to the program stored in its memory, and it should be noted that the above described embodiments by no means limit this invention.

Figure 4:
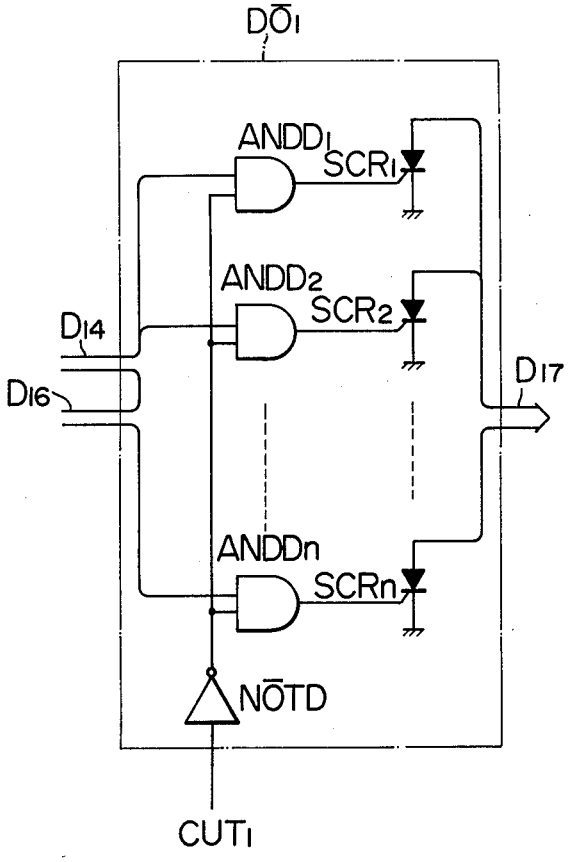

FIG. 4 shows a concrete example of the output interface circuit shown in FIG. 1. The output interface circuit $DO_1$ serves to amplify the outputs of the MICCOM's $MC_1$ and $MC_R$ to drive the output elements such as the lamps $L_{1l}$–$L_{1n}$ and the relays $R_{1l}$–$R_{1n}$ and also to inhibit the delivery of unwanted data from the MICCOM's $MC_1$ and $MC_R$. Namely, when the output inhibit signal $CUT_1$ turns to "1", the "not" circuit NOTD inverts the input "1" to "0" so that the "and" circuit $ANDD_1$–$ANDD_n$ inhibit the data $D_{14}$ and $D_{16}$ from the MICCOM's $MC_1$ and $MC_R$. Accordingly, signals "0" are applied to the gates of the thyristors $SCR_1$–$SCR_n$ so that the output elements such as the lamps and the relays are not energized. On the other hand, when the output inhibit signal $CUT_1$ is "0", the operation contrary to the above described one will follow. The gates of the $SCR_1$–$SCR_n$ directly receive the data $D_{14}$ and $D_{16}$ from the MICCOM's $MC_1$ and $MC_R$ to control the elevator cage.

Figure 5:
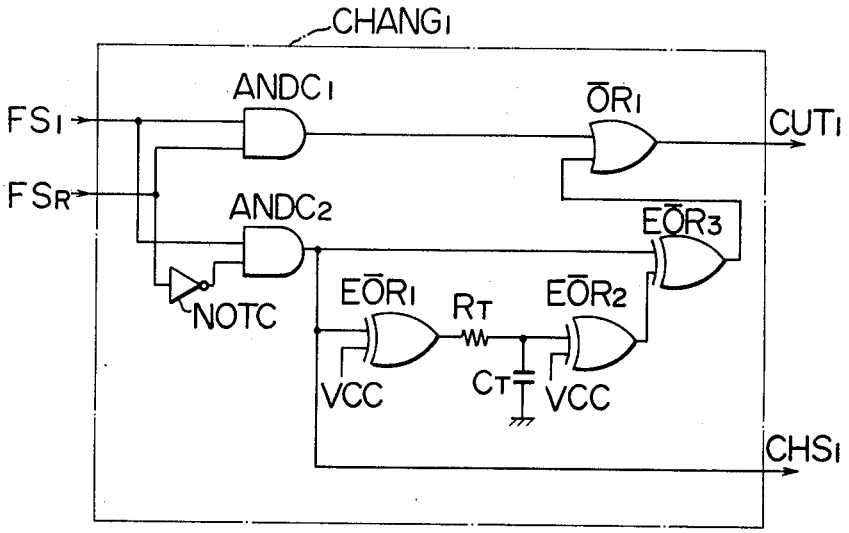
Figure 6:
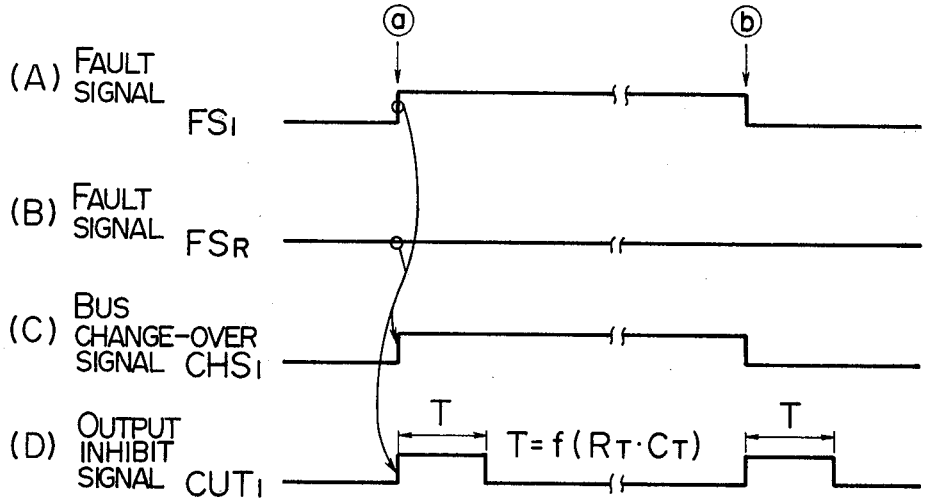

FIG. 5 shows a concrete example of the bus change-over control circuit $CHANG_1$ shown in FIG. 1. The change-over control circuit $CHANG_1$ delivers a change-over signal $CHS_1$ to the bus switch $BSW_1$ and the output inhibit signal $CUT_1$ to the output interface circuit $DO_1$. The bus change-over signal $CHS_1$ is generated, as apparent from the table I given above, when the sub-MICCOM $MC_R$ is normal and the main MICCOM $MC_1$ is in fault. Now, it is assumed that a fault is identified if the outputs $FS_1$ and $FS_R$ of the fault detecting circuits $WDT_1$ and $WDT_R$ are "1" and that the normal state is assured if the outputs $FS_1$ and $FS_R$ are "0". Then, the "and" circuit $ANDC_2$ makes a logical product when $FS_1$="1" (indicating that $MC_1$ is in fault) and $FS_R$="0" (indicating that $MC_R$ is normal), so that the bus change-over signal $CHS_1$ is "1", changing over the bus switch $BSW_1$ to connect the terminal 3 with the terminal 2.

On the other hand, when both the MICCOM's $MC_1$ and $MC_R$ are in fault, that is, $FS_1$="1" and $FS_R$="1", the "and" circuit $ANDC_1$ makes a logical product "1" which is delivered as the output inhibit signal $CUT_1$ through the "or" circuit $OR_1$. Accordingly, the output inhibit signal $CUT_1$ is "1" in this case. Also, the output inhibit signal $CUT_1$ is delivered for a desired period of time when the bus change-over signal $CHS_1$ is changed from "0" to "1" or from "1" to "0". Thus, when the buses are changed over, the operation of the cage is stopped (as in an emergency) by inhibiting the output of the output interface circut $DO_1$, so that the disorder due to the change-over may be prevented. For this purpose, there is provided a circuit for delivering a pulse having a predetermined duration, comprising exclusive "or" circuits $EOR_1$, $EOR_2$ and $EOR_3$, a resistor $R_T$ and a capacitor $C_T$. The duration is determined by controlling the values of the resistor $R_T$ and the capacitor $C_T$ and set equal to the time required for the emergency stop of the cage. The exclusive "or" circuits $EOR_1$–$EOR_3$ make use of C.MOS $IC_3$s.

FIG. 6(A), (B), (C) and (D) is the time chart for the bus change-over control circuit $CHANG_1$ shown in FIG. 5. In FIG. 6(A), (B), (C) and (D), the instants indicated at ⓐ and ⓑ are respectively the moments when the main MICCOM $MC_1$ falls in a fault and recovers from a fault. Namely, the input $FS_1$ becomes "1" at the instant ⓐ and simultaneously the bus change-over signal $CHS_1$ becomes "1" and thereafter the output inhibit signal $CUT_1$ continues to be "1" for a predetermined period T of time. The input $FS_1$ is changed to "0" at the instant ⓑ and the bus change-over signal $CHS_1$ is simultaneously changed to "0" and thereafter the output inhibit signal $CUT_1$ continues to be "1" for the predetermined period T.

Next, programs for the main MICCOM $MC_1$ and the sub-MICCOM $MC_R$ will be explained with the aid of FIGS. 7 and 8.

Figure 7:
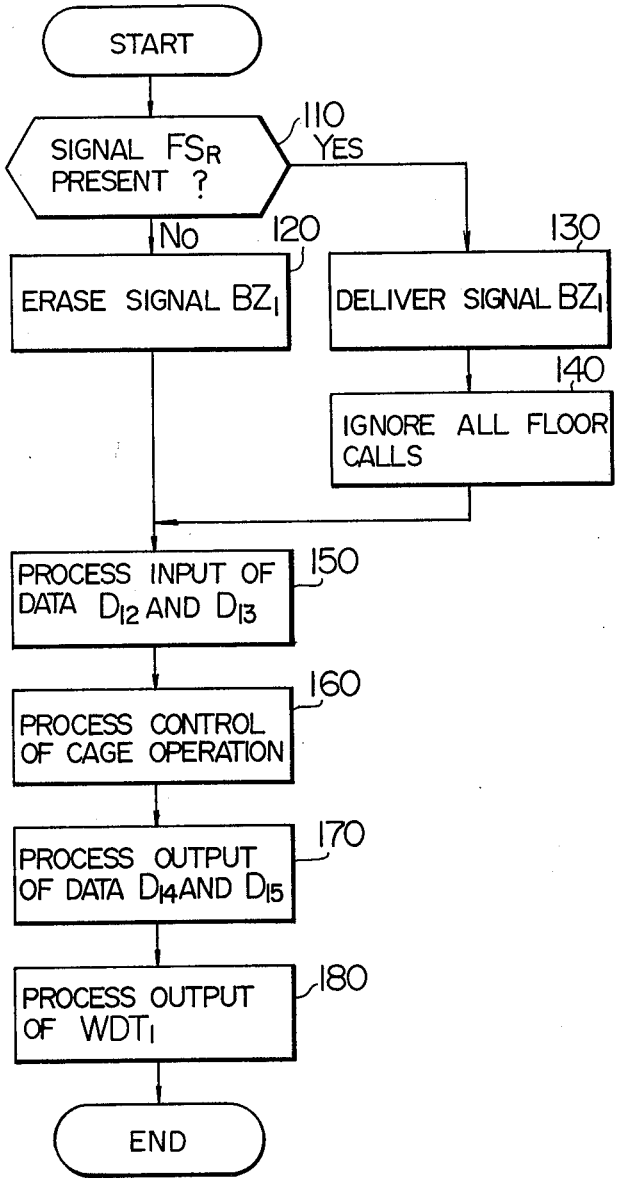

FIG. 7 is a flow chart illustrating an example of the program for the main MICCOM $MC_1$, the program being synchronously executed at a period of several tens of milliseconds.

First, whether there is the signal $FS_R$ indicating a fault in the main MICCOM $MC_1$, is checked (step 110). If there is no signal $FS_R$, the warning $BZ_1$ is turned off (step 120). On the other hand, if the signal $FS_R$ is present, the buzzer $BZ_1$ is turned on (step 130) and then all the floor calls are ignored (step 140). After the above processing has been completed, the input data $D_{12}$ and $D_{13}$ is processed in the step 150. Next, in the step 160, the respective operational control for the cage, such as the door control, the direction control and the acceleration or deceleration control, are processed. The results of the processing of the operational controls is obtained in the step 170, the data $D_{14}$ and $D_{16}$ being delivered. Finally in the step 180, a pulse is delivered to the fault detecting circuit $WDT_1$ which serves to detect a fault in the main MICCOM $MC_1$. The circuit $WDT_1$ judges that the main MICCOM $MC_1$ is in fault, unless such a pulse is received at a constant period.

Figure 8:
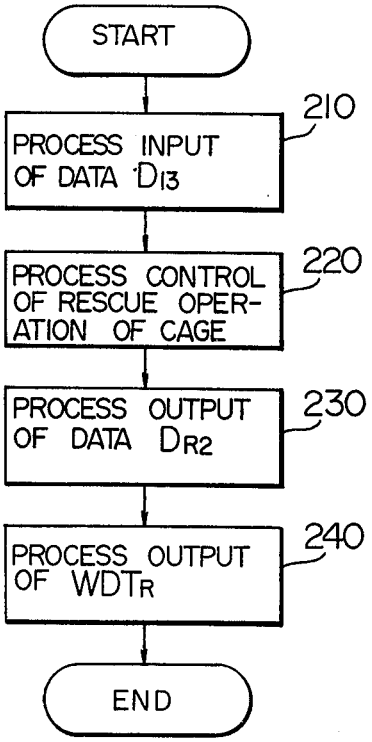

FIG. 8 is a flow chart illustrating an example of the processing program for the sub-MICCOM $MC_R$. This program is also synchronously executed at a period of several tens of milliseconds.

First, the input processing of the data $D_{13}$ necessary for the control of the rescue operation is executed (step 210) and then the processing of the control of the rescue operation is executed on the basis of the above processed data (step 220). Next, in the step 230, the hitherto processed result is delivered as output data $D_{R2}$. Finally in the step 240, a pulse is delivered to the fault detecting circuit $WDT_R$ so as to detect a fault in the sub-MICCOM $MC_R$, and this program is completed. This program is continuously executed so long as the sub-MICCOM $MC_R$ is normal. However, since the bus switch $BSW_1$selects the terminal 1 when the main MICCOM $MC_1$ is normal, then the output of the sub-MICCOM $MC_R$ is not supplied to the output interface circuit $DO_1$. If the main MICCOM $MC_1$ falls in a fault, the bus switch $BSW_1$ selects the terminal 2 so that the output of the sub-MICCOM $MC_R$ is supplied to the output interface circuit $DO_1$ to execute a rescue operation.

The processing of the rescue operation control (step 220 in FIG. 8) in which the features of this invention is embodied, will be described in detail below.

Figure 9:
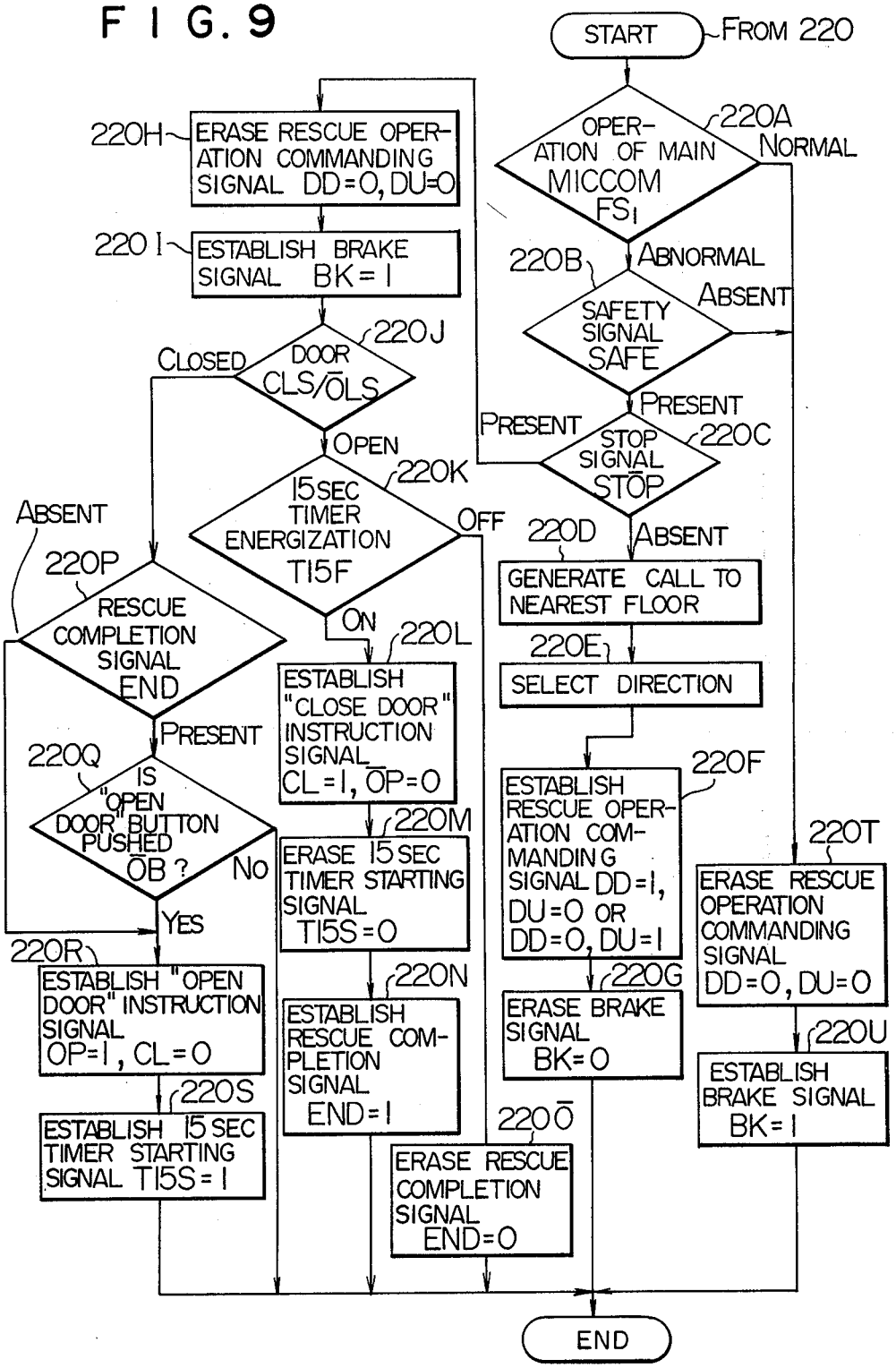
Figure 10:
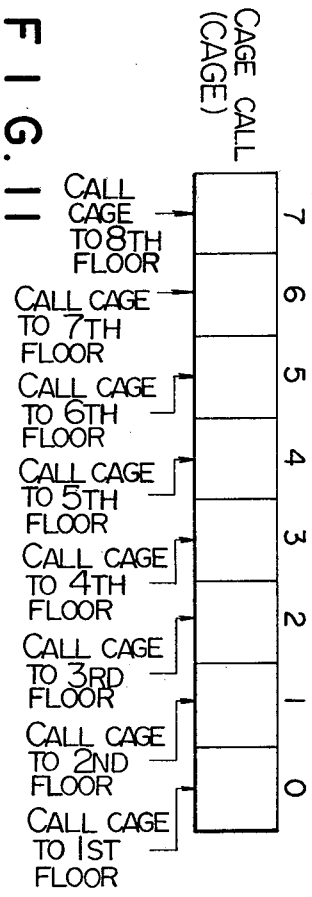
Figure 11:
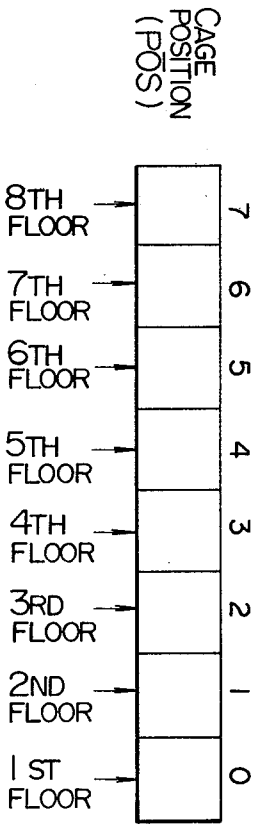
Figure 12:
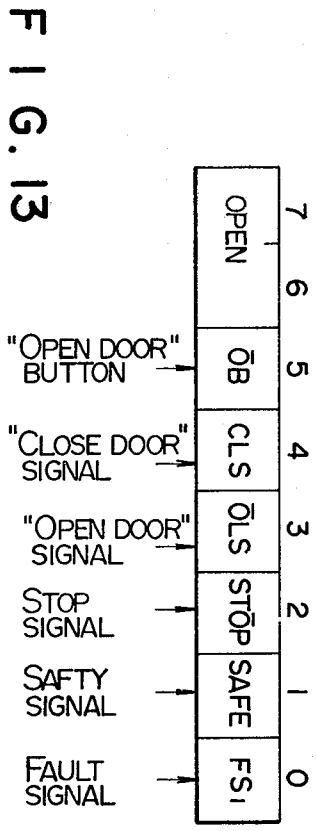
Figure 13:
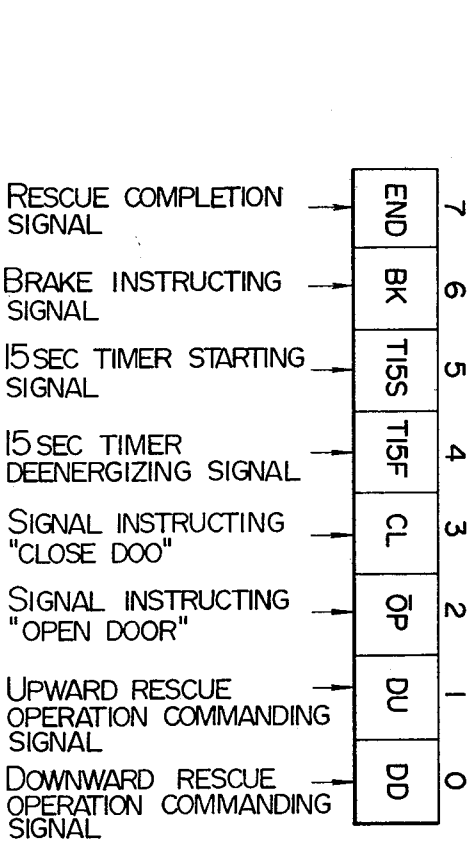

FIG. 9 is a flow chart concretely illustrating the processing of the control of the rescue operation and FIGS. 10–13 are the tables of the input and output of the information used in the flow chart shown in FIG. 9. The following description refers to the reference symbols used in FIGS. 10–13, concentrated mainly on the flow chart in FIG. 9.

First, the condition of the main MICCOM $MC_1$ at operation is checked. When the main MICCOM $MC_1$ is normally operating, the rescue operation commanding signals DD and DU are erased (step 220T) and the braking signal BK is established. The sub-MICCOM $MC_R$ does not perform the processing of the rescue operation control.

On the other hand, if the main MICCOM $MC_1$ falls in a fault, the safety signal SAFE as the signal for assuring the safety of operating the cage is checked (step 220B) and if the safety signal SAFE is detected, the following rescue operation control processing is performed.

Namely, the stop signal STOP indicating whether the cage is at the floor level, that is, at the same level with any floor, is checked (step 220C). If the cage is in an intermediate position between floors, a call for moving the cage to the nearest floor is generated (step 220p). The processing of direction selection is performed (step 220E) according to the position of the cage and the generated call. The rescue operation commanding signals DD and DU are established (step 220F) and the breaking signal BK is erased, so that the cage is ready for an immediate operation (step 220G). For example, in the case where the cage is moved downward in a rescue operation, the downward rescue operation commanding signal DD is made to take "1" and the upward rescue operation commanding signal DU is rendered to be "0". In this way, the rescue operation is started and the cage is moved slowly.

As soon as the case has approached a desired floor level, that is, the stop signal STOP has been detected in the step 220C, the rescue operation commanding signals DD and DU are both erased (step 220H) and instead the breaking signal BK is established (step 220I) so as to stop the movement of the cage. Then, whether the door of the cage is open or not, is checked (step 220J). If the door is closed (CLS=1), the rescue completion signal END is checked (step 220p). If the rescue operation is not yet completed, the step 220R is reached. In the step 220R, the door open commanding signal OP is established. Then, the 15 sec timer starting signal T15S for automatically closing the door 15 sec after the opening of the door, is established (step 220S). Under this condition, the door will be opened if the door opening button OP is pushed while the rescue completion signal END is detected in the step 220p.

In the step 220J, when the door is completely opened (OLS=1), the 15 sec timer deenergizing signal T15F is checked (step 220K). If the signal T15F is not detected, the rescue completion signal END is erased (step 2200). If, on the other hand, the signal T15F is detected, it is judged that the rescue has been completed, that is, the passengers has been rescued from the cage for the period of 15 sec during which the door is open, and the operation of closing the door is started (step 220L). Then, the 15 sec timer starting signal T15S is erased (step 220M) and the rescue completion signal END is established (step 220N). By repeating similar processings, the cage can always be moved to the nearest floor level and the passengers in the cage can be quickly liberated.

As described above, according to this invention, the passengers can be quickly rescued even when the computer for controlling the operation of the cage falls in a fault and when the cage is stopped in the intermediate position between floors. In the above embodiment, the sub-MICCOM $MC_R$ is so designed as to perform only the processing of the rescue operation control. Therefore, in the case where the amount of the input and the output information to be processed is small, just as in the present case, the sub-MICCOM may be a small-capacity microcomputer such as a one-chip microcomputer. Moreover, in the above embodiment, the output data is inhibited when the main MICCOM is in fault and when the change-over from main MICCOM to sub-MICCOM is performed. Accordingly, the elevator system can be prevented from falling into a dangerous condition due to abnormal data.

Another embodiment of this invention will now be described with the aid of FIGS. 14 and 15. This embodiment is a variation of the embodiment desired above in which the main MICCOM $MC_1$ and the sub-MICCOM $MC_R$ perform their processings according to the flow charts shown in FIGS. 7 and 8.

In the above described embodiment, the sub-MICCOM $MC_R$ has only the function of controlling the rescue operation when the main MICCOM is in fault. Therefore, the sub-MICCOM is superfluous when the main MICCOM is normal.

In another embodiment, the sub-MICCOM $MC_R$ shares the function of controlling the operation of the cage with the main MICCOM $MC_1$ so as to diminish the processing burden on the main MICCOM $MC_1$, that is, to improve the processing ability thereof. In that case, however, the control of the operation of the cage becomes impossible even when the sub-MICCOM $MC_1$ falls in a fault, so that the passengers are confined in the cage. Therefore, in this embodiment, to avoid such an accident, the main MICCOM $MC_1$ is also provided with a function of controlling the rescue operation.

For example, the main MICCOM $MC_1$ shares the processings of controlling the cage call, the floor call, the opening and closing of the door, and the cage operation command while the sub-MICCOM $MC_R$ shares the processing of controlling the acceleration and deceleration of the cage (i.e. generating the speed instruction).

The data communication between the main MICCOM $MC_1$ and the sub-MICCOM $MC_R$ is through the data bus $D_{18}$ shown in FIG. 1.

Figure 14:
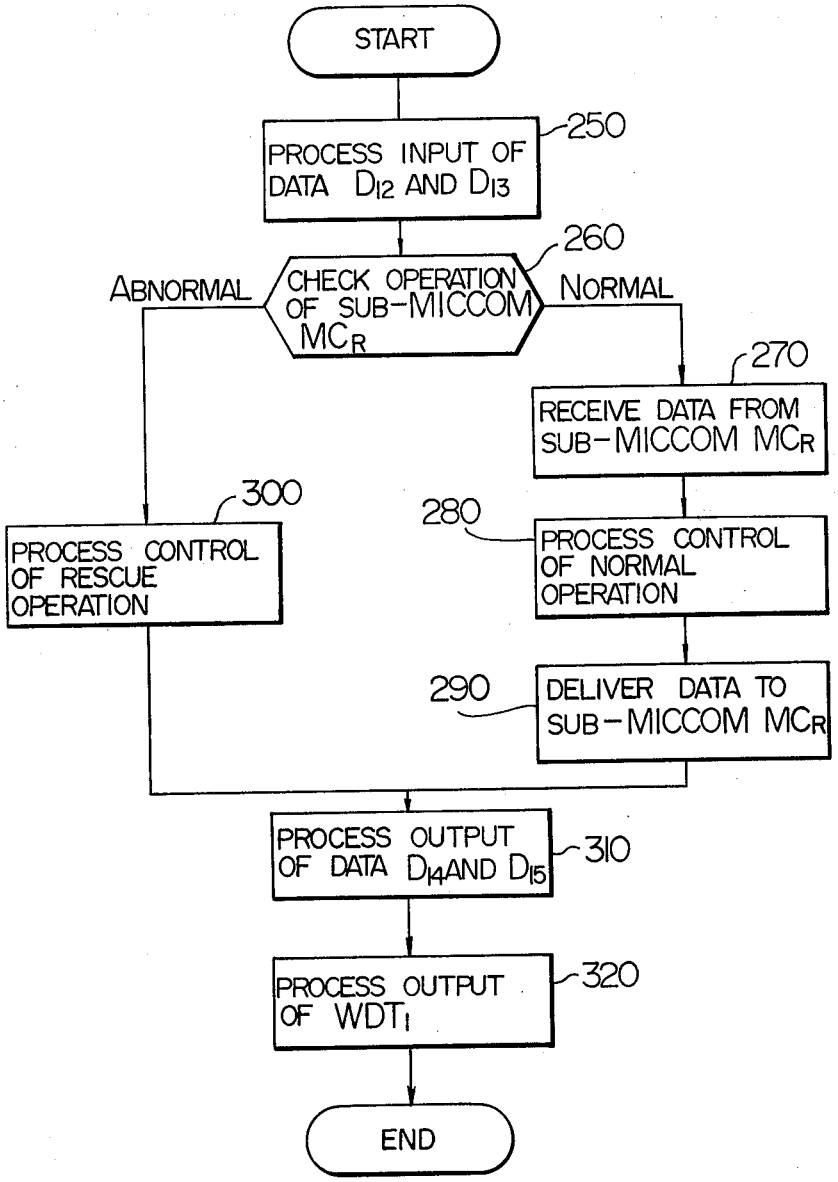
FIGS. 14 and 15 illustrate another embodiment of this invention.
Figure 15:
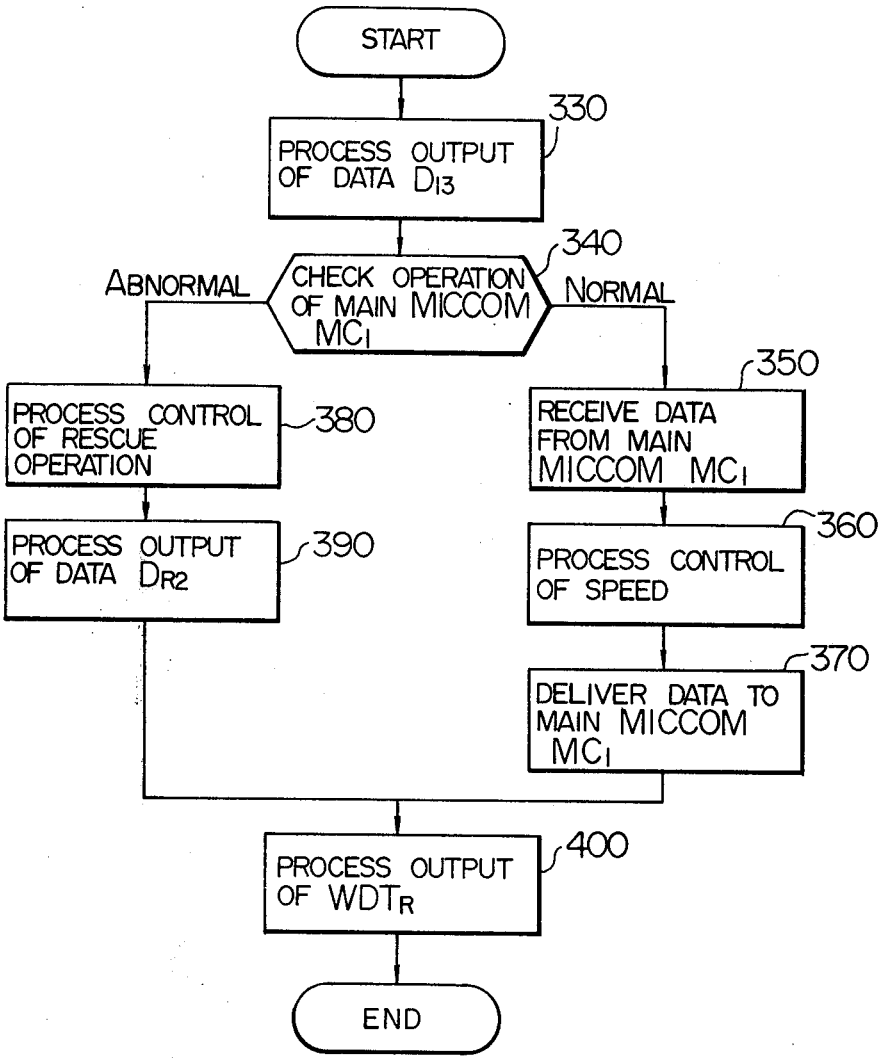

FIGS. 14 and 15 show the flow charts of the processings by the main MICCOM $MC_1$ and the sub-MICCOM in the above described function sharing system.

FIG. 14 is the flow chart of the processing by the main MICCOM $MC_1$, in which the steps 250, 310 and 320 are respectively the same as the steps 150, 170 and 180 in FIG. 7 and the description of the steps 250, 310 and 320 is omitted.

In the step 260, the operating condition of the sub-MICCOM $MC_R$ is checked and if it is normal, the data processed by the sub-MICCOM $MC_R$, such as the acceleration control data, is received through the data bus $D_{18}$ (step 270). The processing of the cage operation control, shared by the main MICCOM $MC_1$, is performed (step 250) and then the data to the sub-MICCOM $MC_R$, such as the operation starting signal and the deceleration starting signal, is transmitted.

On the other hand, if the sub-MICCOM is in fault, the processing of the rescue operation control, which is the same as the processing shown in FIG. 9 and programmed in the main MICCOM $MC_1$, is performed (step 300).

FIG. 15 is the flow chart of the processing by the sub-MICCOM $MC_R$, in which the steps 330, 380, 390 and 400 are respectively the same as the steps 210, 220, 230 and 240 in FIG. 8.

In the step 340, the operating condition of the main MICCOM $MC_1$ is checked and if it is normal, the processing of the speed control, shared by the sub-MICCOM $MC_R$, is performed (step 360). The processing necessary for the data communication between the main MICCOM $MC_1$ and the sub-MICCOM $MC_R$ (steps 350 and 370) is inserted before and after the speed control processing step 360.

If, on the other hand, the main MICCOM $MC_1$ is in fault, the same rescue operation control processings as in FIGS. 8 and 9 are performed.

As described just above, in this embodiment, the main MICCOM $MC_1$ and the sub-MICCOM $MC_R$ share the function of operating the cage with each other. Accordingly, the processing burden on the main MICCOM $MC_1$ can be diminished so that the processing speed and ability can be improved. Further, even though the sub-MICCOM $MC_R$ is disabled in a fault, the rescue operation control can be performed so that the desired purpose can be attained.

Figure 16:
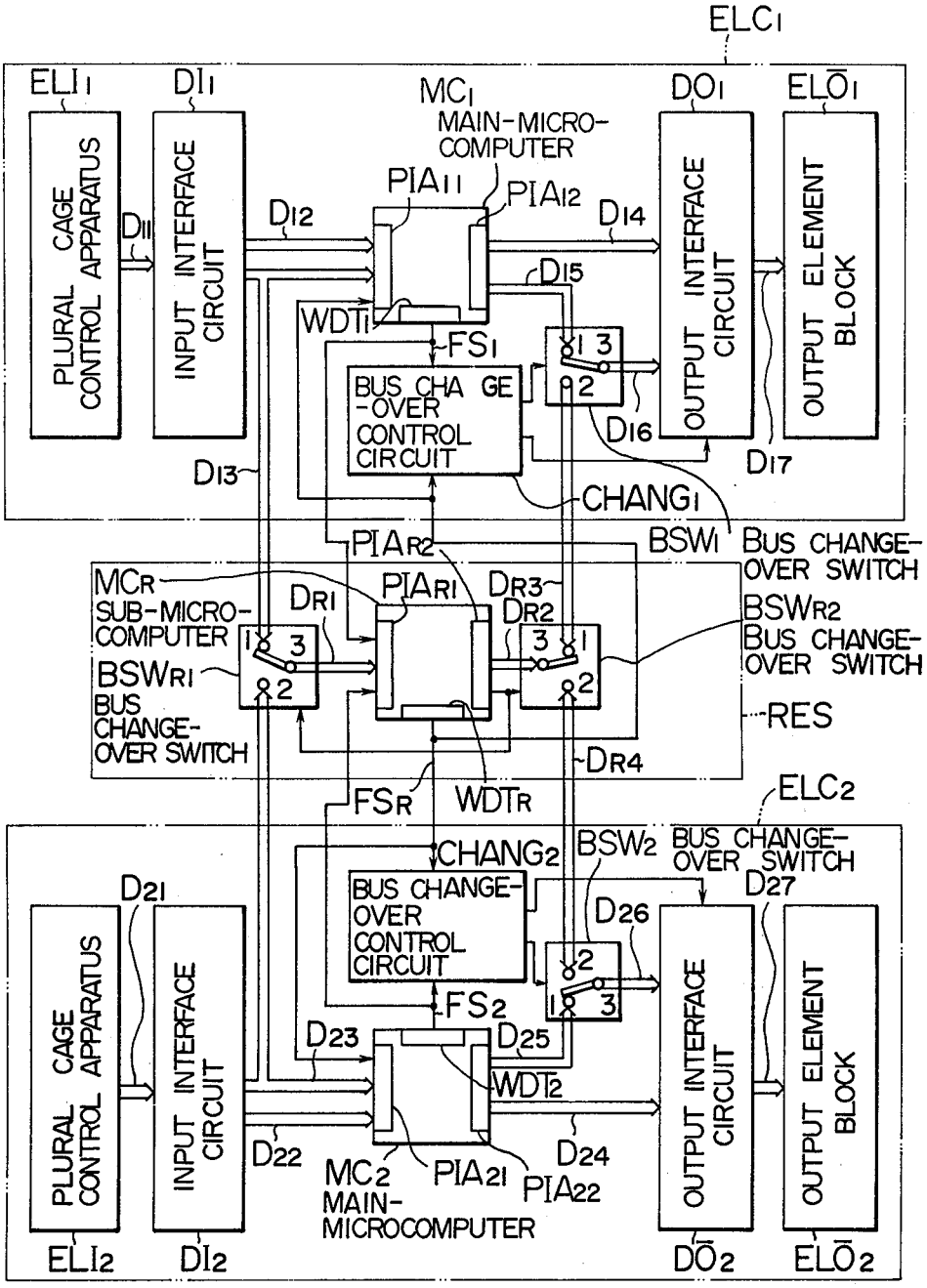
FIG. 16 shows in block diagram form the general constitution of an elevator control apparatus as yet another embodiment of this invention.
Figure 17:
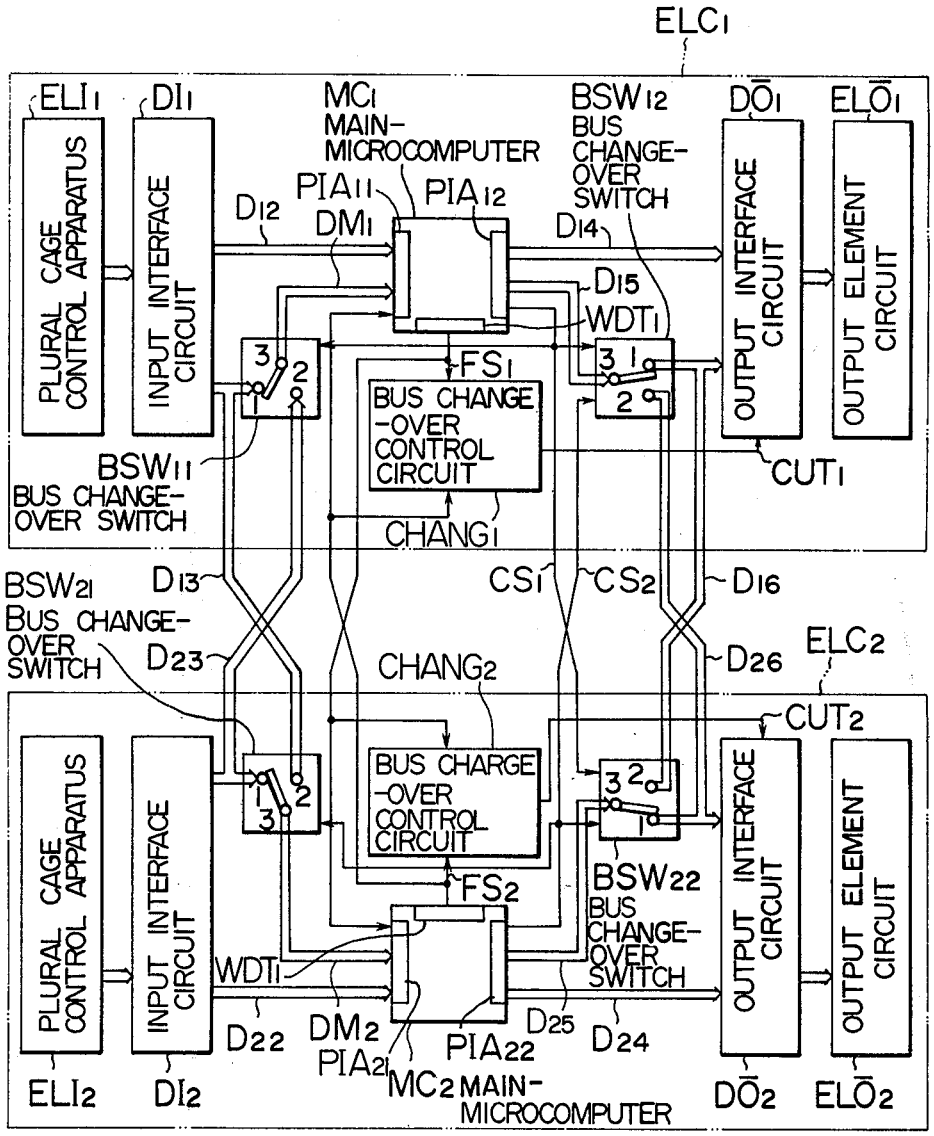
FIG. 17 shows in block diagram form the general constitution of an elevator control apparatus as further embodiment of this invention.

FIGS. 16 and 17 show in block diagram the general constitutions of elevator control apparatuses as other embodiments of this invention.

In the embodiment shown in FIG. 16, a rescue operation control apparatus RES is shared by plural cage control apparatuses $ELC_1$ and $ELC_2$. Therefore, bus switches $BSW_{R1}$ and $BSW_{R2}$ are added to change over the cage control apparatuses $ELC_1$ and $ELC_2$ depending on which one of the cages should be subjected to the rescue operation. Further, two fault detecting signals $FS_1$ and $FS_2$ are received by the sub-MICCOM $MC_R$ so as to judge which one of the main MICCOM's $MC_1$ and $MC_2$ of the cage control apparatuses $ELC_1$ and $ELC_2$ is in fault. The change-over of the bus switches $BSW_1$ and $BSW_2$ by detecting the fault of the cage control apparatus $ELC_1$ or $ELC_2$ depending on the signal $FS_1$ or $FS_2$, can be easily performed according to the stored program. The other configuration of the circuit in FIG. 16 is the same as the corresponding parts of the circuit shown in FIG. 1. The reference symbols attached to the constituents of the cage control apparatus $ELC_1$ are the same as those attached to the corresponding components of the apparatus ELC shown in FIG. 1. The symbolism for the cage control apparatus $ELC_2$ can be obtained simply by substituting "2" for the subscript "1" in case of a single subscript component and for only the anterior subscript "1" in case of a double subscript component, e.g., $DI_1$ to $DI_2$, $DO_1$ to $DO_2$, $PIA_{11}$ to $PIA_{21}$, and $PIA_{12}$ to $PIA_{22}$.

With this embodiment shown in FIG. 16 with the rescue operation control apparatus RES shared by the plural cage control apparatuses, the cost of the whole system can be lowered. However, since the number of the bus switches used in this embodiment is double the number of the bus switches used in the circuit shown in FIG. 1, the reliability of the whole system is lowered. The other effects are the same as those obtained with the circuit shown in FIG. 1.

In FIG. 17 showing yet another embodiment of this invention, the main MICCOM of one cage control apparatus can also serve as the sub-MICCOM of another cage control apparatus for controlling the rescue operation. Namely, the cage control apparatuses $ELC_1$ and $ELC_2$ are connected crosswise with respect to the input and output signals and the bus change-over signals, with each other so that the main MICCOM $MC_1$ of the cage control apparatus $ELC_1$ may serve also as the sub-MICCOM of the cage control apparatus $ELC_2$ and that the main MICCOM $MC_2$ of the cage control apparatus $ELC_2$ may serve also as the sub-MICCOM of the cage control apparatus $ELC_1$. In this case, two, four bus switches $BSW_{11}$, $BSW_{12}$, $BSW_{21}$ and $BSW_{22}$ are used just as in the embodiment shown in FIG. 16. Each of the main MICCOM's $MC_1$ and $MC_2$ has memories for the programs and the data described with FIGS. 9–13 and is started by corresponding one of the fault detecting signals $FS_1$ and $FS_2$.

With this embodiment shown in FIG. 17, there is no need for the separate provision of sub-MICCOM's for the rescue operation control since the main MICCOM of one cage control apparatus serve also as the sub-MICCOM of the other cage control apparatus. Accordingly, the cost of the system in FIG. 17 can be lower than that of the system shown in FIG. 1 or FIG. 16. However, the idea of this embodiment cannot be applied to the case where only one elevator cage is used. Moreover, since numerous bus switches are used just as in the embodiment in FIG. 16, the reliability of the whole system is lowered. The other effects are the same as those obtained with the embodiment shown in FIG. 16.

As described above, according to this invention, passengers can be quickly rescued even when the computer used in the cage control apparatus falls in a fault and therefore the elevator system equipped with the rescue operation control apparatus according to this invention, can be said to be much improved with respect to the safety of the passengers.

What we claim is:

1. A rescue operation control apparatus for an elevator system, comprising an elevator cage available at plural floors; a first and a second computer for receiving at least the information about said cage and for sharing the processing of controlling the operation of said cage; a drive apparatus for driving said cage according to the control signals from said first and second computers; first detecting means for detecting an abnormality occurring in said first computer; second detecting means for detecting an abnormality occurring in said second computer; means provided in said first computer for controlling the rescue operation of said cage by receiving the information at least about the position of said cage when said detecting means detects the abnormality of said second computer; and means provided in said second computer for controlling the rescue operation of said cage by receiving the information at least about the position of said cage when said first detecting means detects the abnormality of said first computer.

2. A rescue operation control apparatus for an elevator system claimed in claim 1, wherein said apparatus further comprises means for transmitting data between said first and second computers, said second computer shares a part of the processing of the cage control operation to be performed in said first computer, and the result of the processing performed in said second computer is transferred to said first computer through said transmitting means.

3. A rescue operation control apparatus for an elevator system claimed in claim 1, wherein said first computer shares at least a processing of registering floor calls and cage calls, and said second computer shares at least the processing of the control of the cage driving speed.

4. A rescue operation control apparatus for an elevator system claimed in claim 1, wherein said apparatus further comprises means for stopping the cage in response to the detection of the abnormality of at least one of said first and second computers by said first and second detecting means, and wherein said rescue operation control means of one of said first and second computers which is not detected to be abnormal by the corresponding detecting means performs the rescue operation after the stoppage of said cage performed by said stopping means.

5. A rescue operation control apparatus for an elevator system claimed in claim 1, wherein said apparatus further comprises means for interrupting said control signals from said first and second computers in response to the detection of the abnormality of at least one of said first and second computers by said first and second detecting means.

6. A rescue operation control apparatus for an elevator system, comprising an elevator cage available at plural floors; a first and a second computer for receiving at least the information about said cage and for controlling the operation of said cage; a drive apparatus for driving said cage according to the control signal from said first computer; first detecting means for detecting an abnormality occurring in said first computer; second detecting means for detecting an abnormality occurring in said second computer; means provided in said second computer for controlling the rescue operation of said cage in response to the detection of abnormality in said first computer by said first detecting means; and means provided in said first computer for controlling a rescue operation of said cage in response to the detection of an abnormality in said second computer by said second detecting means.

7. A rescue operation control apparatus for an elevator system claimed in claim 6, further comprising means in said first computer for ignoring floor calls in response to a detection of an abnormality in said first computer by said first detecting means.

8. A rescue operation control apparatus for an elevator system, comprising first and second elevator cages available at plural floors; a first and a second computer for receiving the information about said first and second elevator cages and for controlling the operation of said first and second elevator cages, respectively; a first drive apparatus for driving said first elevator cage according to the control signal from said first computer; a second drive apparatus for driving said second elevator cage according to the control signal from said second computer; first detecting means for detecting an abnormality occurring in said first computer; second detecting means for detecting an abnormality occurring in said second computer; means provided in said first computer for controlling the rescue operation of said second elevator cage by receiving the information at least about the position of said second elevator cage in response to the detection of abnormality in said second computer by said second detecting means; and means provided in said second computer for controlling the rescue operation of said first elevator cage by receiving the information at least about the position of said first elevator cage in response to the detection of abnormality in said first computer by said first detecting means.

9. A rescue operation control apparatus for an elevator system, comprising first and second elevator cages available at plural floors; a first and a second computer for receiving the information about said first and second elevator cages and for controlling the operation of said first and second elevator cages, respectively; first and second drive apparatus for driving said first and second elevator cages according to the control signals from said first and second computers, respectively; first detecting means for detecting an abnormality occurring in said first computer; second detecting means for detecting an abnormality occurring in said second computer; a third computer for receiving the information about the positions of said first and second elevator cars and receiving the outputs from said first and second detecting means, said third computer controlling the rescue operation of said first elevator cage in accordance with the information about the position of said first elevator cage in response to the detection of abnormality in said first computer by said first detecting means and controlling the rescue operation of said second elevator cage in accordance with the information about the position of said second elevator cage in response to the detection of abnormality in said computer by said second detecting means, third detecting means for detecting an abnormality occurring in said third computer, and means in said first and second computers for controlling the rescue operation of said first and second elevator cages in response to a detection of an abnormality in said third computer by said third detecting means.

10. A rescue operation control apparatus for an elevator system claimed in either of claim 1 or 6, wherein said rescue operation comprises ignoring floor calls from the elevator cage, moving said elevator cage to the nearest floor to said elevator cage for rescue of the passengers, and then resting at said nearest floor.

11. A rescue operation control apparatus for an elevator system claimed in either of claim 8 or 9, wherein said rescue operation of said first elevator cage comprises ignoring floor calls from said first elevator cage and moving said first elevator cage to the nearest floor to said first elevator cage for rescue of the passengers, and then resting at said nearest floor, and said rescue operation of said second elevator cage comprises ignoring floor calls from said second elevator cage and moving said second elevator cage to the nearest floor to said second elevator cage for rescue of the passengers, and then resting at said nearest floor.

* * * * *